US006820774B2

(12) United States Patent
Jones

(10) Patent No.: US 6,820,774 B2
(45) Date of Patent: Nov. 23, 2004

(54) BEVERAGE DISPENSING APPARATUS

(76) Inventor: Donald E. Jones, 126 Long Ridge Dr., Columbia, SC (US) 29229

( * ) Notice: Subject to any disclaimer, the term of this patent is extended or adjusted under 35 U.S.C. 154(b) by 116 days.

(21) Appl. No.: 10/245,615

(22) Filed: Sep. 17, 2002

(65) Prior Publication Data

US 2004/0050870 A1 Mar. 18, 2004

(51) Int. Cl.[7] ..... B67D 5/040
(52) U.S. Cl. ..... 222/383.1; 222/207
(58) Field of Search ..... 222/207, 211, 222/335, 373, 382, 383.1, 385, 400.7, 400.8

(56) References Cited

U.S. PATENT DOCUMENTS

| | | | | | |
|---|---|---|---|---|---|
| 1,460,208 | A | * | 6/1923 | Mohn | 222/398 |
| 1,679,104 | A | * | 7/1928 | Trautman | 222/209 |
| 2,154,393 | A | * | 4/1939 | Bates | 222/397 |
| 2,223,256 | A | * | 11/1940 | Kross | 222/400.8 |
| 3,160,330 | A | * | 12/1964 | Pollitt | 222/209 |
| 4,260,078 | A | | 4/1981 | Kephart | |
| 4,595,121 | A | * | 6/1986 | Schultz | 222/1 |
| 4,667,856 | A | | 5/1987 | Nelson | |
| 4,722,463 | A | | 2/1988 | Anderson | |
| 4,844,290 | A | | 7/1989 | McCurdy et al. | |
| 4,880,161 | A | * | 11/1989 | Wright | 239/330 |
| 5,024,353 | A | | 6/1991 | Horne | |
| 5,326,003 | A | | 7/1994 | Kitto et al. | |
| 5,392,957 | A | | 2/1995 | Parsons | |
| 5,405,058 | A | | 4/1995 | Kalis et al. | |
| 5,738,254 | A | * | 4/1998 | de la Guardia | 222/400.8 |
| 6,264,073 | B1 | * | 7/2001 | Good et al. | 222/464.4 |
| 6,394,316 | B1 | * | 5/2002 | Daansen | 222/207 |

* cited by examiner

*Primary Examiner*—Gene Mancene
*Assistant Examiner*—Melvin A. Cartagena
(74) *Attorney, Agent, or Firm*—Dale J. Ream

(57) ABSTRACT

A kit for dispensing liquid includes a cap for attachment to a container, the cap defining an outlet. An inner tube is attached to the cap for insertion into the container, a first end thereof being in communication with the outlet and a second end telescopically extending below the container's liquid level. A pump is situated on the cap for selectively pumping air into the container through the inner tube. In one embodiment, a cap vent enables air to be drawn into the pump for transfer into the container so as to urge liquid to flow through the inner tube to the outlet. In another embodiment, a cap vent is positioned to maintain a continuous flow of liquid through the inner tube after the pump has initiated a siphon effect. In either embodiment, an outer tube connects the cap outlet with a dispensing mechanism for selectively dispensing liquid.

5 Claims, 8 Drawing Sheets

BEVERAGE DISPENSING APPARATUS

BACKGROUND OF THE INVENTION

This invention relates generally to liquid dispensing devices and, more particularly, to a liquid dispensing apparatus that may be releasably attached to a beverage container and having a pump for dispensing liquid from the container without moving the container from its normal upright position.

Most beverage containers are too large, heavy, or awkward for a child to use conveniently, making adult supervision necessary each time the child desires a drink. For example, a child may have difficulty lifting, carrying, and pouring a standard one gallon milk jug or similar container. Although various liquid dispensing devices have been proposed in the art, these devices either modify the normal orientation of a beverage container or are not conveniently usable on various types or sizes of beverage containers.

Therefore, it is desirable to have a liquid dispensing apparatus that may be attached to a beverage container and used to dispense liquid therefrom without modifying the normal orientation of the container. Further, it is desirable to have a liquid dispensing apparatus that may be used to dispense liquids from containers of various dimensions. In addition, it is desirable to have a liquid dispensing apparatus that may be operated by a child.

SUMMARY OF THE INVENTION

A liquid dispensing apparatus according to the present invention includes a cap for releasable attachment to a beverage container of a type having a neck that defines a container opening. The cap includes a generally tubular configuration formed for a releasable press-fit on the neck of a beverage container. The cap defines an outlet opening in a continuous side wall. The apparatus includes an inner tube having a first end situated in the cap for communication with the outlet opening. The inner tube extends from the cap for insertion into the beverage container, the inner tube being extensible for use with containers of different heights. An air pump is positioned atop the cap for forcing air through the inner tube when pressed. A vent is positioned in the cap for transferring ambient air into the pump for subsequent transfer into the container. Therefore, the pump may be used to increase the volume and thus the pressure of air within the container for the purpose of urging the liquid therein to flow through the inner tube and outlet opening. An outer tube is connected at one end to the cap outlet opening and at another end to a dispensing mechanism. The dispensing mechanism includes a valve for selectively controlling the flow of liquid through an outlet port. The dispensing mechanism includes an ornamental configuration that is entertaining to a child, e.g. the shape of an elephant's head.

Another embodiment of the present invention includes a vent extending through the cap for directly connecting ambient air with the interior of the beverage container. An operation of the pump expels air and liquid from the inner tube so as to create a vacuum that then draws liquid from the container up through the inner tube to the outlet.

Therefore, a general object of this invention is to provide an apparatus for dispensing liquid from a beverage container.

Another object of this invention is to provide a liquid dispensing apparatus, as aforesaid, which is convenient for operation by children.

Still another object of this invention is to provide a liquid dispensing apparatus, as aforesaid, that may be utilized with beverage containers of various sizes.

Yet another object of this invention is to provide a liquid dispensing apparatus, as aforesaid, which can dispense liquid from a container without modifying the position or orientation of the container.

A further object of this invention is to provide a liquid dispensing apparatus, as aforesaid, having a starter pump for initiating a flow of liquid from the container.

A still further object of this invention is to provide a liquid dispensing apparatus, as aforesaid, that is entertaining so as to encourage use by children.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 3:
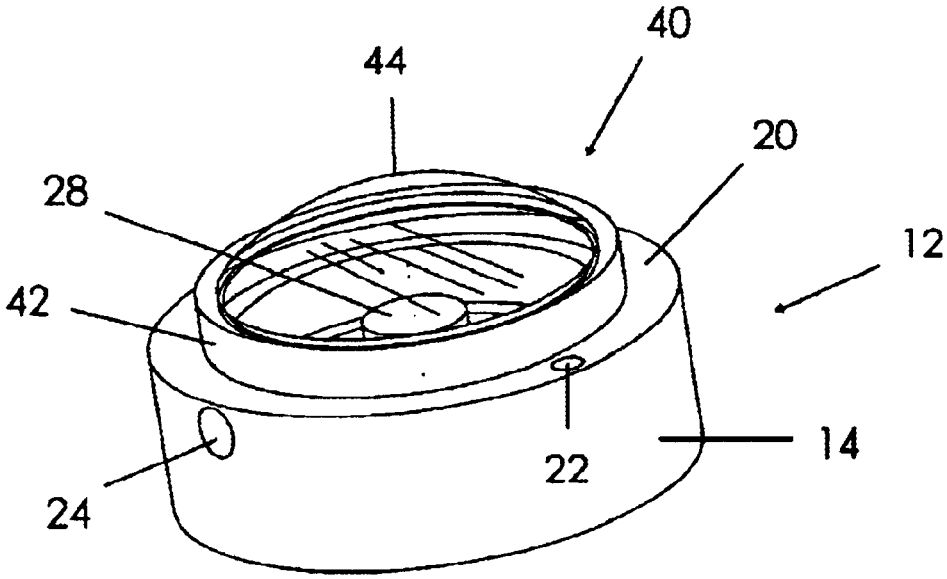
FIG. 3 is a perspective view of a cap removed from the apparatus as in FIG. 1 and shown on an enlarged scale.
Figure 4:
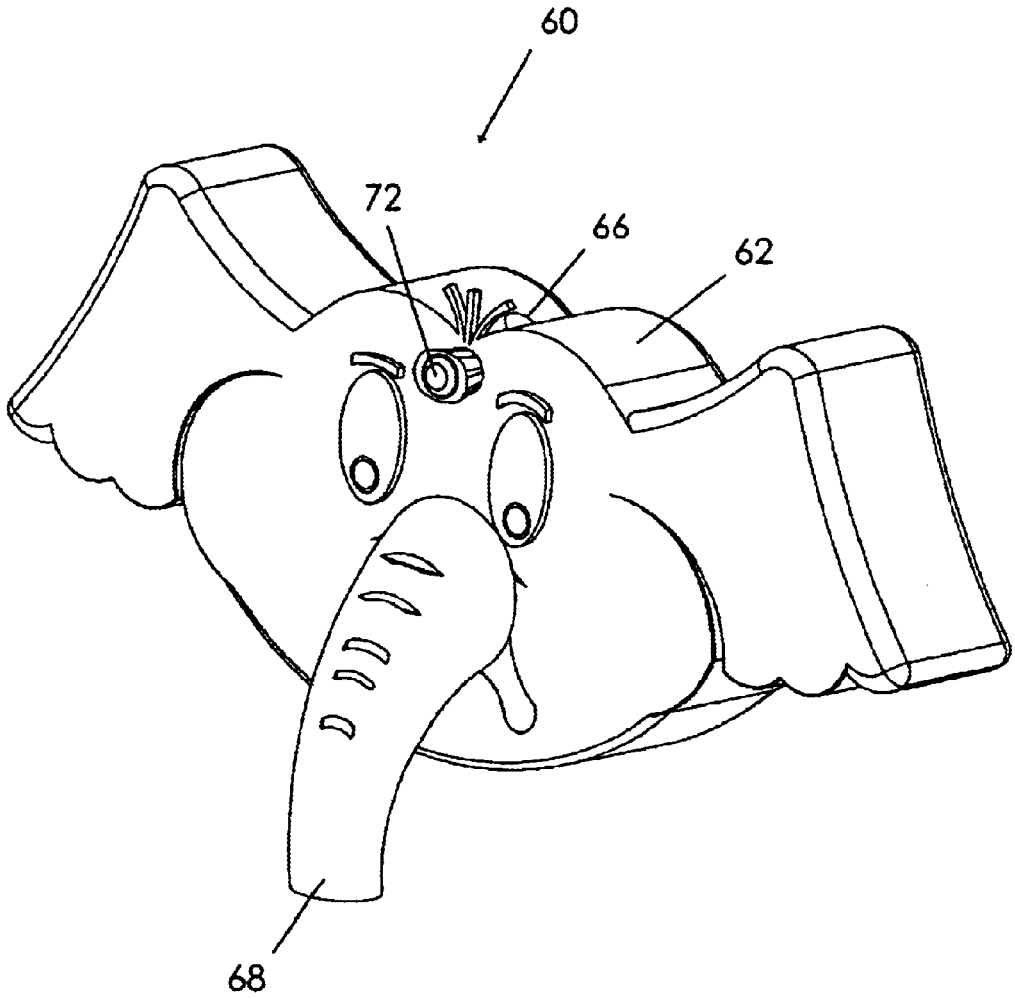
FIG. 4 is a perspective view of a dispensing mechanism removed from the apparatus as in FIG. 1 and shown on an enlarged scale.
Figure 5:
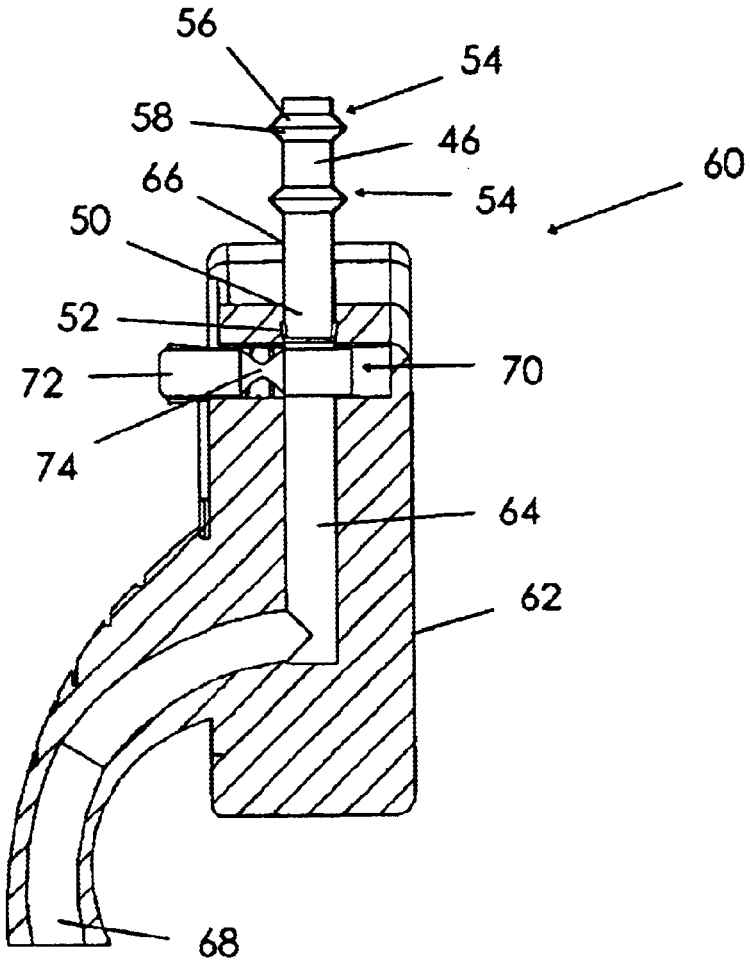
FIG. 5 is a sectional view of the dispensing mechanism taken along line 5—5 on FIG. 1.
Figure 6:
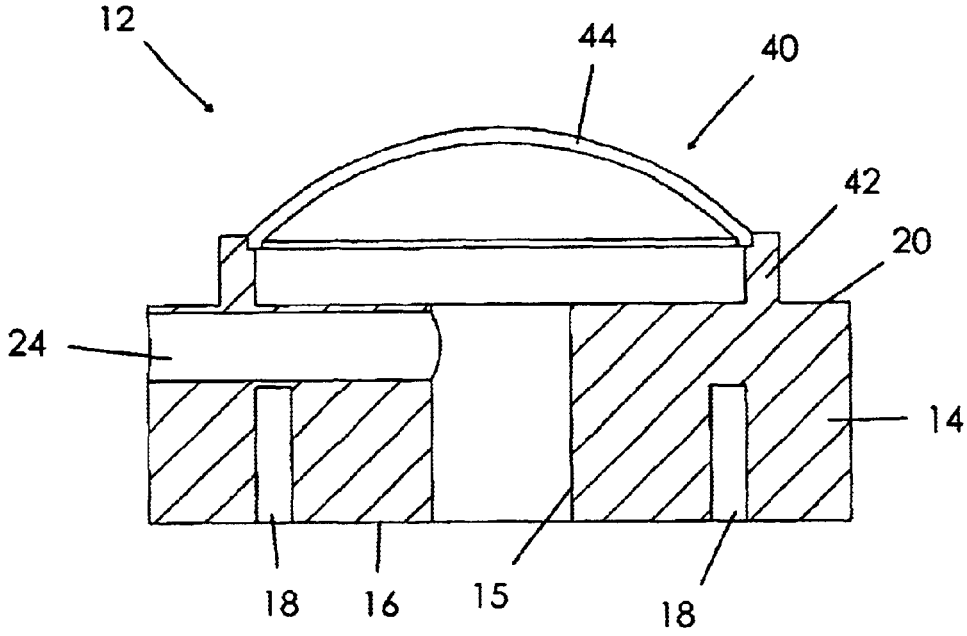
FIG. 6 is a sectional view of the cap taken along line 6—6 on FIG. 2.

A liquid dispensing apparatus according to the present invention will now be described in detail with reference to FIGS. 1 through 8 of the accompanying drawings. A liquid dispensing apparatus 10 according to one embodiment includes a cap 12 having a generally cylindrical configuration with a continuous side wall 14 defining an open top, open bottom, and a central interior bore 15 extending between the top and bottom (FIGS. 3 and 6). The continuous side wall 14 includes a bottom wall 16 defining a continuous slot 18 configured to receive a continuous edge of a container neck, such as the neck of a milk jug. It is understood that the liquid dispensing apparatus 10 of the present invention may include different sized caps for use with beverage containers having necks of different diameters. Therefore, the cap 12 may be releasably coupled to a beverage container 8 in a friction fit relationship. A top edge 20 of the side wall 14 defines a vent 22 for communicating ambient air into the central bore 15 and the side wall 14 defines an outlet opening 24, as to be further described later.

Figure 1:
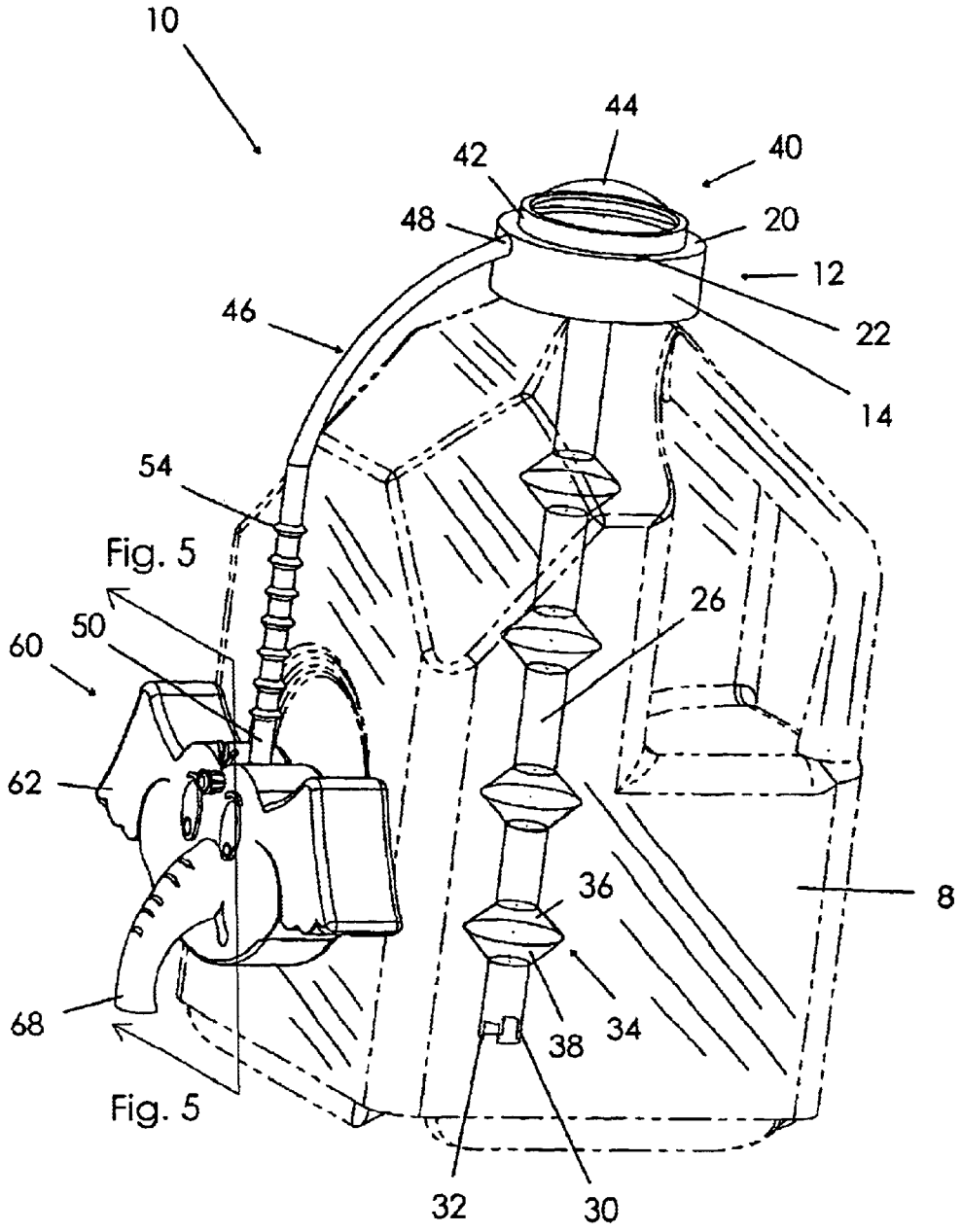
FIG. 1 is a perspective view of a liquid dispensing apparatus in use with a liquid container illustrated in phantom lines according to one embodiment of the present invention.
Figure 2:
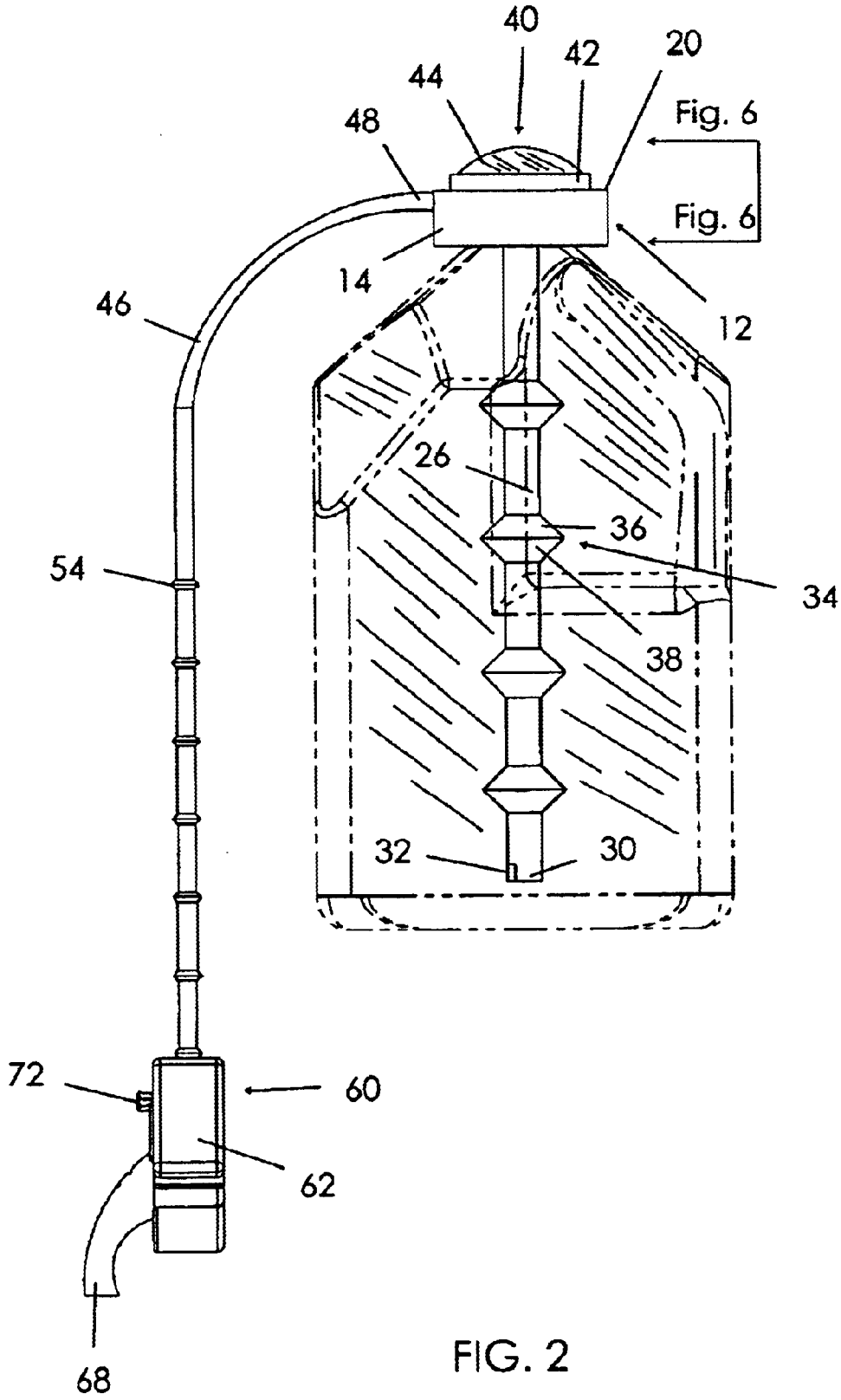
FIG. 2 is a side view of the apparatus as in FIG. 1.

An inner tube 26 depends from the cap 12 (FIG. 1). More particularly, the inner tube 26 includes a first end 28 attached to the inner surface of the continuous side wall 14 of the cap 12, the first end 28 being open and situated in the central bore 15 for communication with the cap open top (FIG. 6). The first end 28 of the inner tube 26 defines a side opening in communication with the vent 22. The inner tube 26 is elongate and depends from the cap 12 such that it may be extended into the beverage container 8 when the cap 12 is attached to the neck of the container 8. The inner tube 26 defines an open second end 30 opposite the first end 28 and that defines a plurality of slots 32 for enhanced fluid flow to and from the inner tube 26 (FIG. 1). The inner tube 26 further includes a plurality of spaced apart inner tube extension segments 34. Each inner tube extension segment 34 includes upper 36 and lower 38 portions connected to one another along a parting line for movement in an accordion-like fashion. Therefore, the inner tube 26 may telescope so as to be used in liquid containers having various depths. The inner tube 26 may alternatively include an extensible construction that utilizes multiple telescopically connected tubular segments.

A starter pump 40 is mounted atop the continuous side wall 14 of the cap 12. More particularly, a continuous upper wall 42 is mounted atop the continuous side wall 14 and is concentric relative thereto (FIG. 3). A dome 44 constructed of a flexible material is fixedly attached atop the upper wall 42. The dome 44 seals the open top of the cap 12 such that a user depression of the dome 44 forces air through the open bottom. The expulsion of air from the central bore of the cap 12 causes ambient air from outside the cap 12 to be drawn in through the air vent 22 when the dome 44 is released. This drawn in air may then be expelled downwardly into the container 8 upon another operation of the pump dome 44, and so on. Therefore, each operation of the pump 40 pushes more air into the container 8, thereby increasing the air pressure therein until liquid in the container is forced back up the inner tube 26 and out the cap outlet opening 24 for dispensing as further described below.

The liquid dispensing apparatus 10 includes an outer tube 46 having a first end 48 coupled to the outlet opening 24 of the cap 12 (FIG. 1). The outer tube 46 includes a plurality of spaced apart extension segments 54, each outer tube extension segment 54 having upper 56 and lower 58 portions connected to one another along a parting line for accordion-like movement. Therefore, the outer tube 46 may be utilized with liquid containers of various heights. Of course, the outer tube 46 may include an extensible construction that utilizes multiple telescopically connected tubular segments.

The outer tube 46 includes a second end 50 opposed to the outer tube first end 48 coupled to a liquid dispensing mechanism 60. The dispensing mechanism 60 includes a housing 62 constructed in the form of an animal or cartoon character, such as an elephant's head (FIG. 4). The dispensing mechanism housing 62 includes an inner channel 64 extending internally between an inlet port 66 and an outlet port 68 (FIG. 5). The second end 50 of the outer tube 46 includes a nub 52 extending diametrically thereabout that may be releasably nested within a corresponding recess in the inlet port 66 of the dispensing mechanism housing 62. While the nub 52 is nested in a tight friction fit relationship so as to form a seal, this configuration enables the housing 62 to be rotated axially about the outer tube 46.

The dispensing mechanism 60 includes a push-button valve 70 situated on the housing 62 between the inlet 66 and outlet 68 ports. The push-button valve 70 includes a spring-loaded flange 72 normally biased to block the channel 64 and thereby prevent the flow of liquid between the inlet 66 and outlet 68 ports (FIG. 5). However, the spring-loaded flange 72 includes a dispensing portion 74 that allows liquid to flow therethrough when the flange 72 is depressed and the dispensing portion 74 is aligned with the inner channel 64.

It is understood that the cap 12 with pump 40, inner tube 26, outer tube 46, and dispensing mechanism 60 may be releasably coupled together such that the liquid dispensing apparatus 10 may be a kit that enables a user to utilize components of various sizes and configurations, as desired.

In use, a cap 12 of a selected size coupled to an inner tube 26 is connected to a desired beverage container 8 such that the inner tube 26 extends into the container 8 (FIG. 1). It is understood that the starter pump 40 is situated atop the cap 12. The first end 48 of the outer tube 46 may be coupled to the outlet opening 24 of the cap 12 and the second end 50 may be rotatably connected to the inlet port 66 of the dispensing mechanism 60. The dome 44 of the starter pump 40 may then be depressed repeatedly so as to repeatedly force air into the liquid container 8 until the pressure thereof causes the liquid in the container 8 to be urged back up the inner tube 26 and through the outlet opening 24 and down the outer tube 46. The liquid is stopped by the push-button valve 70 until the flange 72 thereof is operated by a user. A depression thereof allows the liquid to flow out of the outlet port 68 such as into a user's glass.

Figure 8:
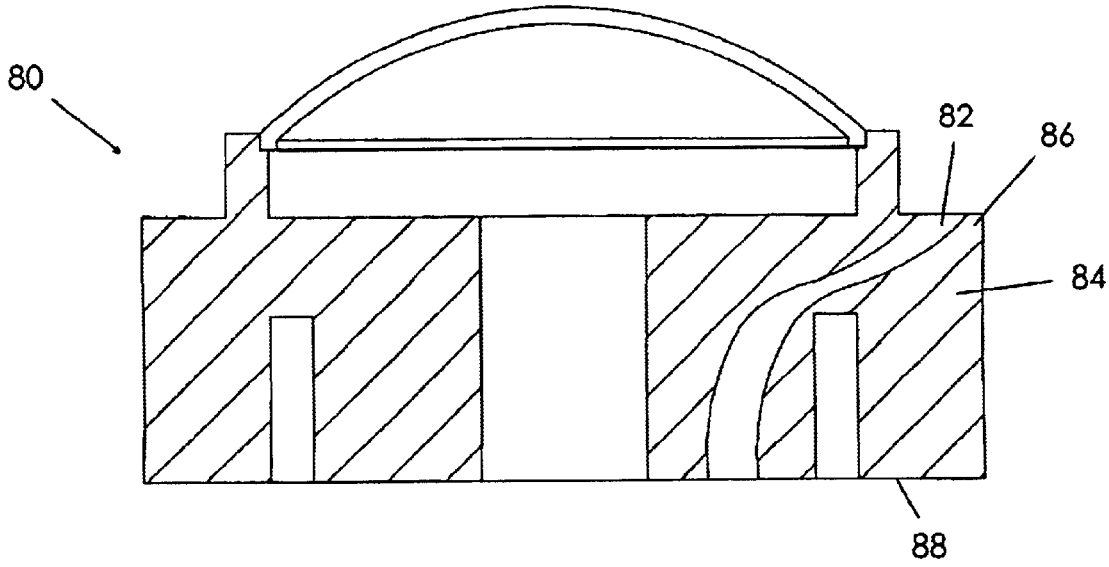
FIG. 8 is a sectional view of a cap as in FIG. 6 according to another embodiment of the present invention.

A liquid dispensing apparatus cap 80 according to another embodiment of the present invention is shown in FIG. 8 and includes a construction substantially similar to the cap 12 described except as noted below. More particularly, this cap 80 includes an air vent 82 that extends between a top edge 86 of the continuous side wall 84 through a bottom wall 88 thereof. This air vent 82 allows ambient air to be drawn into the beverage container to which the cap 80 is attached as liquid from the container is removed. In other words, as a volume of liquid is removed/dispensed, a corresponding volume of air is drawn into the container 8 to replace the liquid. This represents a closed system. In operation, an operation of the pump 40 evacuates the inner tube of any air or liquid therein so as to create a vacuum in the inner tube. Once a vacuum is established in the inner tube, liquid from the container is drawn therein so as to replace the removed air. A sufficient vacuum will draw the liquid completely up the inner tube and out through the outlet opening (not shown). As liquid flows out, air is drawn into the container 8 through the vent 82 to replace the exiting liquid. Thus, a siphon is established and the flow will continue so long as the dispensing mechanism is operated to allow the liquid to flow out of the outlet port as previously described. Of course, fluid dynamics only allows this continuous flow so long as the elevation of the outlet port of the dispensing mechanism is below the level of liquid in the container 8. In addition, an auxiliary flexible tube (not shown) may be connected about the air vent 82 and either be suspended freely downwardly from the cap 80 or even be coupled to the outer tube 46 and dispensing mechanism 60 shown in FIG. 1. Having a downwardly extending tube would allow air intake as liquid is dispensed, as described above, while preventing the loss of carbonation in the case where the container holds a carbonated beverage.

Figure 7:
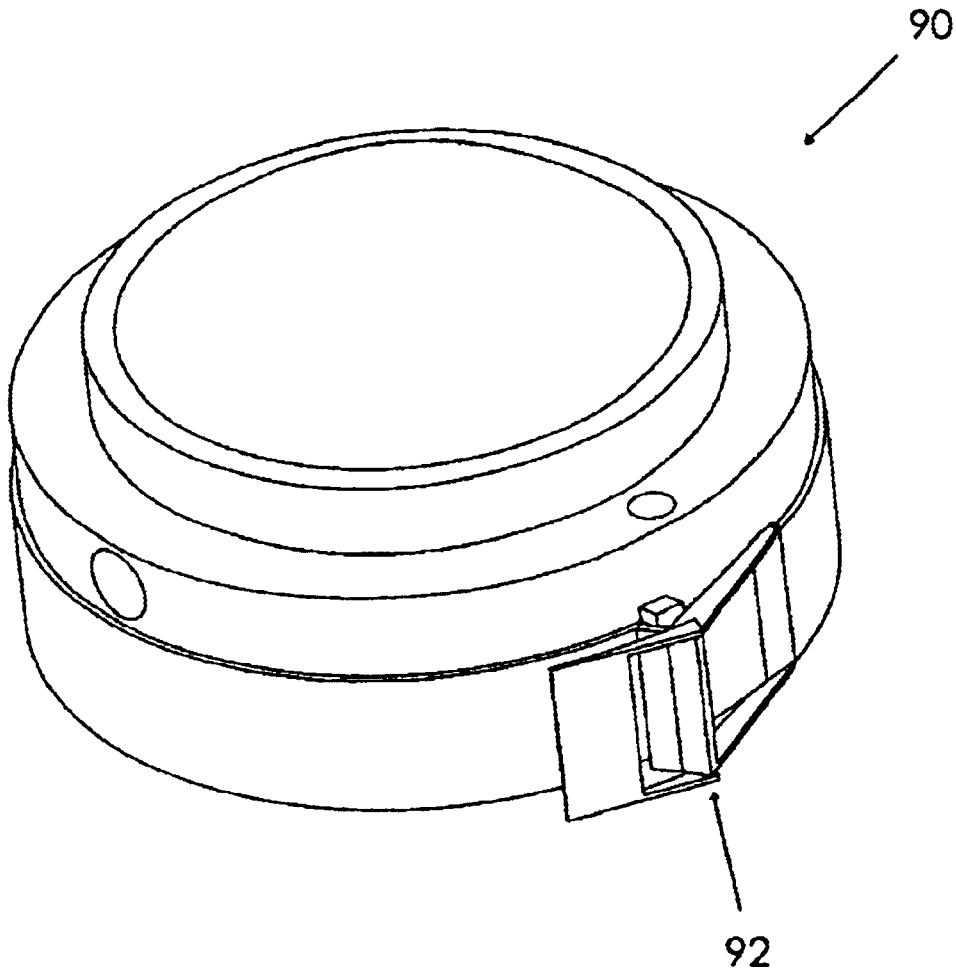
FIG. 7 is a perspective view of a cap according to another embodiment of the present invention.

A cap 90 according to another embodiment of the present invention is shown in FIG. 7 and includes a construction substantially similar to the cap 12 initially described except as noted below. This cap 90 includes a latch clamp 92 by which the cap 90 may be tightened about the neck of a liquid container. In this embodiment, the cap 90 may be coupled to container necks of various sizes rather than requiring multiple caps of different sizes.

In yet another embodiment (not shown), the outlet port of the dispensing mechanism (e.g. trunk of the elephant's head) may be pivotally coupled to the housing such that it may be rotated 360° as desired by user.

It is understood that while certain forms of this invention have been illustrated and described, it is not limited thereto except insofar as such limitations are included in the following claims and allowable functional equivalents thereof.

What is claimed is:

1. A liquid dispensing apparatus for attachment to a liquid container having a neck defining an opening, said liquid dispensing apparatus, comprising:

a cap having a generally cylindrical configuration complementary to a configuration of said neck of said container for releasable connection thereto, said cap defining an outlet;

an extensible inner tube having an inner tube first end attached to said cap and situated for communication with said outlet, said inner tube depending from said cap for insertion into said container when said cap is connected to said neck;

a pump situated in said cap in communication with said inner tube first end for transferring air therethrough;

a vent on said cap for communicating air into said pump;

whereby an operation of said pump transfers air through said inner tube and into said container for urging a liquid in said container to flow through said inner tube to said outlet;

an extensible outer tube having an outer tube first end coupled to said outlet of said cap and an opposed outer tube second end;

a dispenser mechanism having an inlet port formed to receive said outer tube second end and having an outlet port;

a spring-loaded valve on said dispenser mechanism intermediate said inlet port and said outlet port for selectively allowing a liquid to flow from said outer tube to said outlet port;

wherein said outer tube second end includes means for coupling said outer tube second end to said inlet port in a snap-fit relationship wherein said dispenser mechanism may be selectively rotated about said outer tube second end; and wherein said inner tube includes a second end opposite said inner tube first end, said inner tube second end defining at least one slot for fluid transfer between said inner tube and said container.

2. The liquid dispensing apparatus as in claim 1 wherein said inner tube includes a plurality of spaced apart extension segments, each segment having upper and lower portions selectively movable relative to one another in accordion fashion.

3. The liquid dispensing apparatus as in claim 1 wherein said outer tube includes a plurality of spaced apart outer tube extension segments, each outer tube extension segment having upper and lower portions for movement relative to one another in accordion fashion.

4. The liquid dispensing apparatus as in claim 1 wherein said dispensing mechanism is in the form of an elephant head.

5. A kit for dispensing liquid from a liquid container of a type having a neck defining an opening, said kit comprising:

a cap having a generally tubular configuration with top and bottom walls and a continuous side wall extending between said top and bottom walls, said cap defining a central bore between said top and bottom walls and defining an outlet through said side wall;

means on said bottom wall of said cap for releasably coupling said cap to said neck of said container;

a vent extending through said side wall between said top and bottom walls adjacent said central bore for transferring air into said container when said cap is coupled to said neck;

an extensible inner tube having an inner tube first end situated in said central bore of said cap and in communication with said outlet, said inner tube depending from said cap for insertion into said container when said cap is connected to said neck;

a pump positioned atop said cap in communication with said inner tube first end for selectively evacuating air from said inner tube and into said container, whereby to cause a vacuum within said inner tube that draws liquid from said container into said inner tube and through said outlet;

an extensible outer tube having an outer tube first end coupled to said outlet of said cap and an opposed outer tube second end;

a dispenser mechanism having an inlet port formed to receive said outer tube second end and having an outlet port;

a spring-loaded valve on said dispenser mechanism intermediate said inlet port and said outlet port for selectively allowing a liquid to flow from said outer tube to said outlet port;

wherein said inner tube includes a plurality of spaced apart inner tube extension segments, each inner tube extension segment having upper and lower portions selectively movable relative to one another in accordion fashion; and wherein said outer tube includes a plurality of spaced apart outer tube extension segments, each outer tube extension segment having upper and lower portions for movement relative to one another in accordion fashion;

wherein said outer tube second end includes means for rotatably nesting said outer tube second end in said inlet port of said dispenser mechanism, whereby said dispensing mechanism may rotate about an imaginary axis defined by said outer tube;

wherein said inner tube includes a second end opposite said inner tube first end, said inner tube second end defining at least one slot for fluid transfer between said inner tube and said container.

* * * * *